US010901347B1

(12) United States Patent
Ichiki et al.

(10) Patent No.: US 10,901,347 B1
(45) Date of Patent: Jan. 26, 2021

(54) INTERMEDIATE TRANSFER DEVICE AND IMAGE FORMING APPARATUS INCLUDING AN ENDLESS BELT, A FIRST CLEANING UNIT AND A SECOND CLEANING UNIT

(71) Applicant: FUJI XEROX CO., LTD., Tokyo (JP)

(72) Inventors: Yukihiro Ichiki, Kanagawa (JP); Sota Hara, Kanagawa (JP); Tomoya Oki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/751,360

(22) Filed: Jan. 24, 2020

(30) Foreign Application Priority Data

Sep. 19, 2019 (JP) ..... 2019-170174

(51) Int. Cl.
*G03G 15/16* (2006.01)
*G03G 21/00* (2006.01)

(52) U.S. Cl.
CPC ..... *G03G 15/168* (2013.01); *G03G 15/161* (2013.01); *G03G 21/0011* (2013.01); *G03G 2215/1661* (2013.01)

(58) Field of Classification Search
CPC ... G03G 15/161; G03G 15/168; G03G 21/168
USPC ..... 399/101, 121
See application file for complete search history.

(56) References Cited

U.S. PATENT DOCUMENTS 6,311,031 B1 10/2001 Hirano
7,379,686 B2 * 5/2008 Nishikawa ..... G03G 15/161 399/101
7,627,263 B2 * 12/2009 Takishita ..... G03G 15/161 399/101
8,457,520 B2 * 6/2013 Kamimura et al. ..... G03G 21/1647 399/121
9,235,165 B2 * 1/2016 Makino ..... G03G 15/161

FOREIGN PATENT DOCUMENTS

JP 2000-275983 A 10/2000
JP 2003-215938 A 7/2003

* cited by examiner

*Primary Examiner* — William J Royer
(74) *Attorney, Agent, or Firm* — Sughrue Mion, PLLC

(57) ABSTRACT

An intermediate transfer device includes: an endless belt that circulates, receives transfer of a toner image at a first transfer position, and holds the toner image until the toner image reaches a second transfer position at which the toner image is transferred to a transfer receiver; a first cleaning unit that is disposed downstream of the second transfer position and upstream of the first transfer position in a circulation direction of the belt and removes residual toner from the belt after transfer; and a second cleaning unit that is disposed downstream of the first cleaning unit and upstream of the first transfer position in the circulation direction and removes residues from the belt after removal by the first cleaning unit, in which the second cleaning unit includes: a contact cleaning part that extends in a width direction intersecting the circulation direction and is in contact with the belt; and a support guide receiving part that supports the contact cleaning part, and receives a guide for attachment to and detachment from an image forming apparatus main body by sliding in the width direction.

12 Claims, 4 Drawing Sheets

INTERMEDIATE TRANSFER DEVICE AND IMAGE FORMING APPARATUS INCLUDING AN ENDLESS BELT, A FIRST CLEANING UNIT AND A SECOND CLEANING UNIT

CROSS-REFERENCE TO RELATED APPLICATIONS

This application is based on and claims priority under 35 USC 119 from Japanese Patent Application No. 2019-170174 filed Sep. 19, 2019.

BACKGROUND

(i) Technical Field

The present disclosure relates to an intermediate transfer device and an image forming apparatus.

(ii) Related Art

There is known an image forming apparatus including an intermediate transfer device including an endless belt that holds a toner image until the toner image is transferred to a transfer receiver after the toner image is transferred in a circulating manner. In addition, there is also known an image forming apparatus including an attachable and detachable type intermediate transfer device that is attached to and detached from an image forming apparatus main body.

The intermediate transfer device is provided with a cleaning unit, such as a cleaning blade for removing residual toner after transfer from a belt.

Here, JP-A-2003-215938 discloses a configuration including a rubber blade and a brush roll as a powder removing member disposed upstream thereof.

JP-A-2000-275983 discloses a configuration including a cleaning blade and a cleaning brush disposed downstream thereof.

Even when the cleaning unit that cleans the belt with the cleaning blade and the like is provided, minute residues, such as toner fragments or external additives that have slipped through the belt are pressed between the belt and a transfer roll and the like, and strongly adhere to the belt, and there is a concern that cleaning defects occur.

SUMMARY

Aspects of non-limiting embodiments of the present disclosure relate to providing an intermediate transfer device attachable to and detachable from a main body of an image forming apparatus, which includes a belt, a contact cleaning part, and a support guide receiving part for receiving guide for attachment to and detachment from the main body of the image forming apparatus, and which can remove residues with a simple structure when pressing the contact cleaning part against the belt, as compared with a case where such a support guide receiving part is not employed and such residues could fail to be removed.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an intermediate transfer device including: an endless belt that circulates, receives transfer of a toner image at a first transfer position, and holds the toner image until the toner image reaches a second transfer position at which the toner image is transferred to a transfer receiver; a first cleaning unit that is disposed downstream of the second transfer position and upstream of the first transfer position in a circulation direction of the belt and removes residual toner from the belt after transfer; and a second cleaning unit that is disposed downstream of the first cleaning unit and upstream of the first transfer position in the circulation direction and removes residues from the belt after removal by the first cleaning unit, the second cleaning unit including: a contact cleaning part that extends in a width direction intersecting the circulation direction and is in contact with the belt; and a support guide receiving part that supports the contact cleaning part, and receives a guide for attachment to and detachment from an image forming apparatus main body by sliding in the width direction.

BRIEF DESCRIPTION OF THE DRAWINGS

Exemplary embodiments of the invention will be described in detail based on the following figures, wherein.

DETAILED DESCRIPTION

Hereinafter, an exemplary embodiment of the present disclosure will be described.

Figure 1:
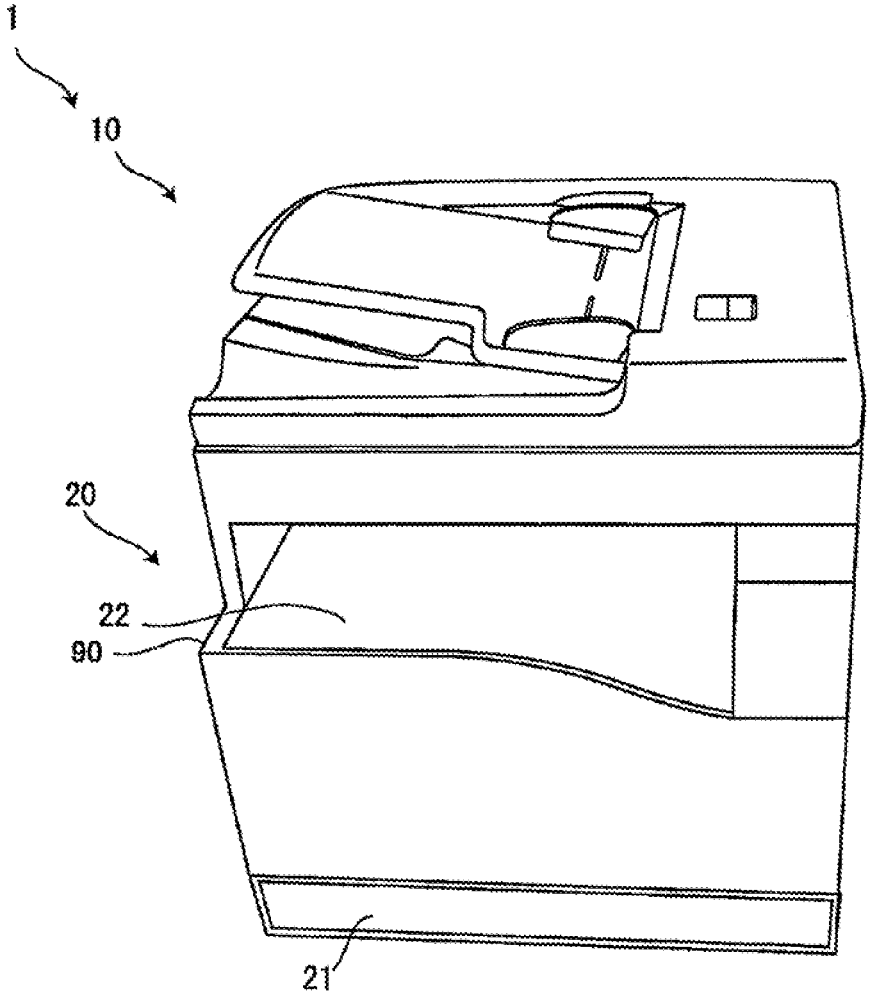
FIG. 1 is an external perspective view of an image forming apparatus as an exemplary embodiment of the present disclosure.

FIG. 1 is an external perspective view of an image forming apparatus as an exemplary embodiment of the present disclosure.

An image forming apparatus 1 includes a scanner 10 and a printer 20.

The scanner 10 is placed on an apparatus housing 90 that is a framework of the image forming apparatus 1, and the printer 20 is configured in the apparatus housing 90.

Figure 2:
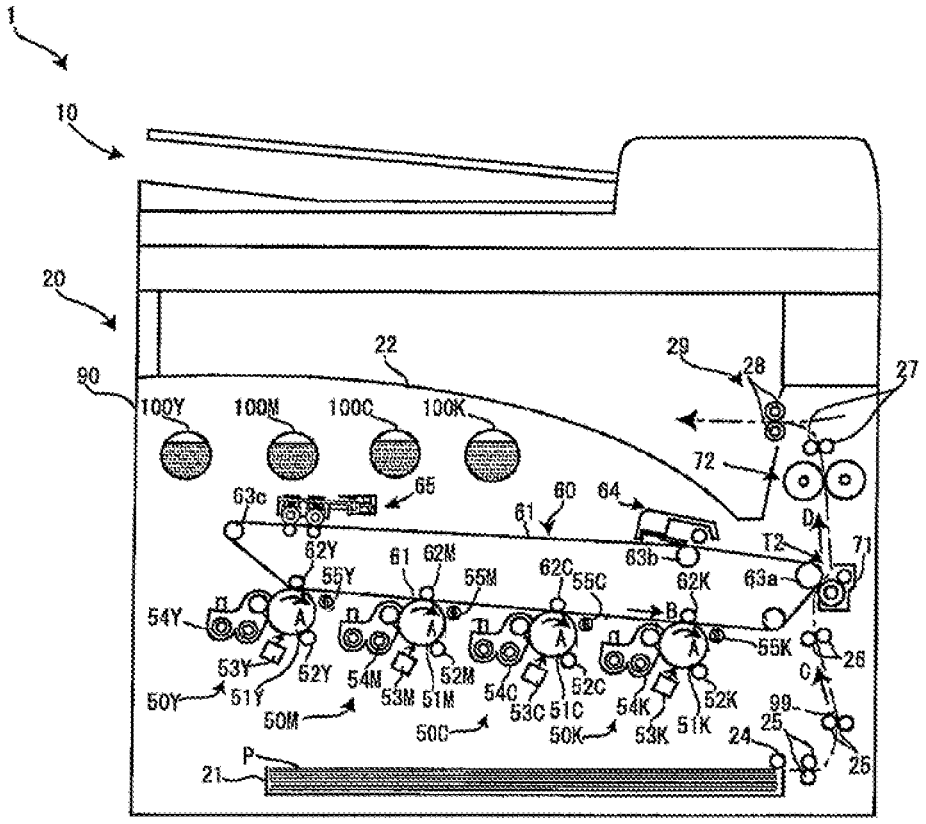
FIG. 2 is a schematic view illustrating an internal configuration of the image forming apparatus of which appearance is illustrated in FIG. 1.

FIG. 2 is a schematic view illustrating an internal configuration of the image forming apparatus of which appearance is illustrated in FIG. 1.

The printer 20 includes four image forming units 50Y, 50M, 50C, and 50K that are arranged in one row substantially horizontally. In the image forming units 50Y, 50M, 50C, and 50K, toner images are formed with toners of yellow (Y), magenta (M), cyan (C), and black (K), respectively. Here, for the description common to the image forming units 50Y, 50M, 50C, and 50K, the symbols Y, M, C, and K, which indicate the distinction of the toner colors, are omitted and denoted as the image forming unit 50. The same applies to other configuration elements other than the image forming unit 50.

Each image forming unit 50 is provided with an image holding member 51. The image holding member 51 receives a driving force and rotates in an arrow A direction to form an electrostatic latent image on the surface thereof, and further, a toner image is formed by development.

Around each image holding member 51 provided in each image forming unit 50, a charger 52, an exposure device 53, a developing device 54, a primary transfer device 62, and a cleaner 55 are provided. Here, the primary transfer device 62 is placed at a position at which the primary transfer device 62 interposes an intermediate transfer belt 61 which will be described later with the image holding member 51. The primary transfer device 62 is an element provided not in the image forming unit 50 but in an intermediate transfer unit 60 which will be described later.

The charger 52 uniformly charges the surface of the image holding member 51.

The exposure device 53 irradiates the uniformly charged image holding member 51 with exposure light modulated based on an image signal to form an electrostatic latent image on the image holding member 51.

A developer containing a carrier and toner having a color that corresponds to each image forming unit 50 is accommodated in the developing device 54. In the developing device 54, the electrostatic latent image formed on the image holding member 51 is developed with toner having a color that corresponds to each image forming unit 50 to form a toner image on the image holding member 51.

The primary transfer device 62 transfers the toner image temporarily held on the image holding member 51 onto the intermediate transfer belt 61 which will be described later.

The cleaner 55 removes residual toner and the like on the image holding member 51 after the transfer, from above the image holding member 51.

An attachable and detachable type intermediate transfer unit 60 is disposed above the four image forming units 50. The intermediate transfer unit 60 is provided with the intermediate transfer belt 61. The intermediate transfer belt 61 is supported by plural rolls, such as a driving roll 63*a*, a driven roll 63*b*, and a tension roll 63*c*. The intermediate transfer belt 61 is driven by the driving roll 63*a* to circulate in an arrow B direction on a circulation path including paths along the four image holding members 51 provided in the four image forming units 50.

The toner images on each image holding member 51 are transferred so as to sequentially overlap the intermediate transfer belt 61 by the action of the primary transfer device 62. The toner image transferred onto the intermediate transfer belt 61 is transported to a secondary transfer position T2 by the intermediate transfer belt 61. A secondary transfer device 71 is provided at the secondary transfer position T2, and the toner image on the intermediate transfer belt 61 is transferred onto a paper sheet P that can be transported to the secondary transfer position T2 by the action of the secondary transfer device 71. The transport of the paper sheet P will be described later. The toner or the like remaining on the intermediate transfer belt 61 after the transfer of the toner image onto the paper sheet P is removed from the intermediate transfer belt 61 by a first cleaner 64.

A second cleaner 65 is further provided in the upper portion of the intermediate transfer belt 61 in the intermediate transfer unit 60. In the second cleaner 65, residues, such as toner debris or external additives that could not be removed from above the intermediate transfer belt 61 by the first cleaner 64 are removed.

Here, the intermediate transfer unit 60 corresponds to an example of the intermediate transfer device of the present disclosure. The intermediate transfer belt 61 corresponds to an example of the belt according to the present disclosure. Furthermore, the first cleaner 64 and the second cleaner 65 correspond to each example of the first cleaning unit and the second cleaning unit, respectively, according to the present disclosure.

A toner cartridge 100 that accommodates the toner having each color is provided in the upper portion of the intermediate transfer unit 60. When the toner in the developing device 54 is consumed by the development, the toner is replenished to the developing device 54 from the toner cartridge 100 accommodating the corresponding color toner through a toner supply path (not illustrated). The toner cartridge 100 is configured to be attachable to and detachable from the apparatus housing 90, and when the toner cartridge 100 is empty, the toner cartridge 100 is taken out and a new toner cartridge 100 is mounted.

One paper sheet P is taken out from a paper sheet tray 21 by a pickup roll 24, and is transported by transport rolls 25 to a timing adjustment rolls 26 in an arrow C direction on a transport path 99. The paper sheet P transported to the timing adjustment rolls 26 is fed out toward the secondary transfer position so as to reach the secondary transfer position T2 in accordance with the timing at which the toner image on the intermediate transfer belt 61 reaches the secondary transfer position T2 by the timing adjustment rolls 26. The paper sheet P fed out by the timing adjustment rolls 26 receives the transfer of the toner image from the intermediate transfer belt 61 by the action of the secondary transfer device 71 at the secondary transfer position T2. The paper sheet P that has received the transfer of the toner image is further transported in an arrow D direction while being guided by a paper sheet guide toward a fixing machine 72 disposed above the secondary transfer device 71.

The toner image on the paper sheet P that is transported in the arrow D direction and has reached the fixing machine 72 is heated and pressurized by the fixing machine 72 and fixed on the paper sheet P. Accordingly, an image made of the fixed toner image is printed on the paper sheet P. The paper sheet P on which the toner image has been fixed by the fixing machine 72 is further transported by transport rolls 27 and is fed out from a paper ejection outlet 29 onto an ejection tray 22 by ejection rolls 28.

Next, a structure of the intermediate transfer unit 60, particularly, the second cleaner 65, will be described.

Figure 3:
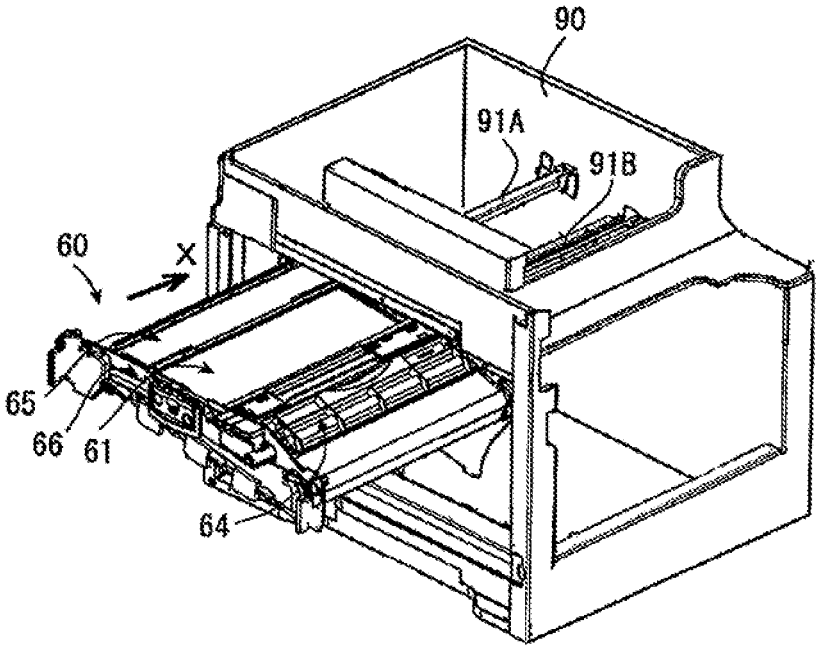
FIG. 3 is a perspective view illustrating a housing of an image forming apparatus main body and an intermediate transfer unit mounted on the housing.

FIG. 3 is a perspective view illustrating the housing of an image forming apparatus main body and the intermediate transfer unit mounted on the housing.

Two frame guides 91A and 91B are provided in the apparatus housing 90 of the image forming apparatus main body. The frame guides 91A and 91B have rear end portions fixed to the apparatus housing 90 and extend forward. The intermediate transfer unit 60 is inserted into the apparatus housing 90 in an arrow X direction while being guided by the frame guides 91A and 91B. The intermediate transfer unit 60 is accommodated in the apparatus main body and is in contact with the image holding member 51, the secondary transfer device 71 and the like. Therefore, each part is configured to have a backlash that makes it possible to move a little with respect to each other such that the parts can follow the members even when there is a tolerance in the members in the apparatus main body.

Figure 4:
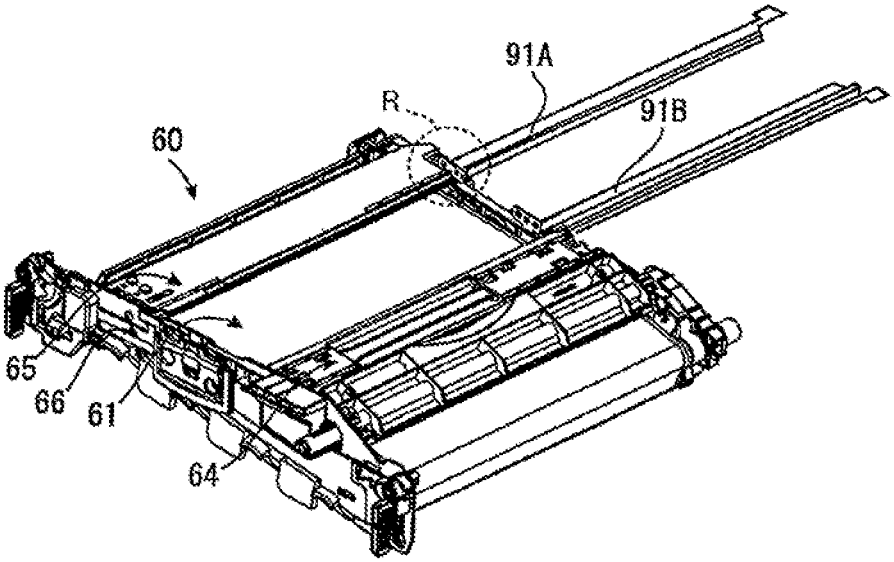
FIG. 4 is a perspective view illustrating a frame guide and an intermediate transfer unit without illustrating an apparatus housing.

FIG. 4 is a perspective view illustrating the frame guide and the intermediate transfer unit without illustrating the apparatus housing.

Figure 5:
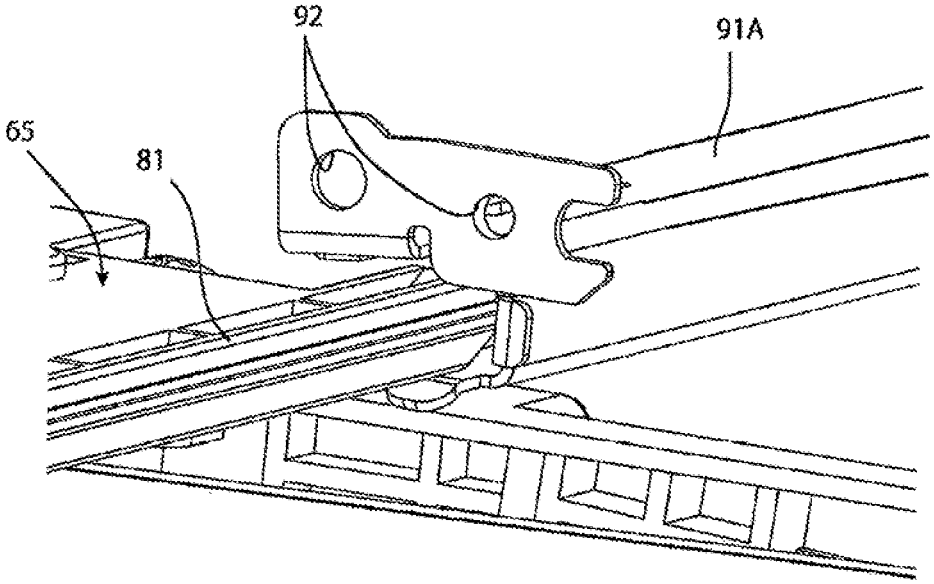
FIG. 5 is an enlarged view of a part of a circle R illustrated in FIG. 4.

FIG. 5 is an enlarged view of a part of a circle R illustrated in FIG. 4.

Figure 6:
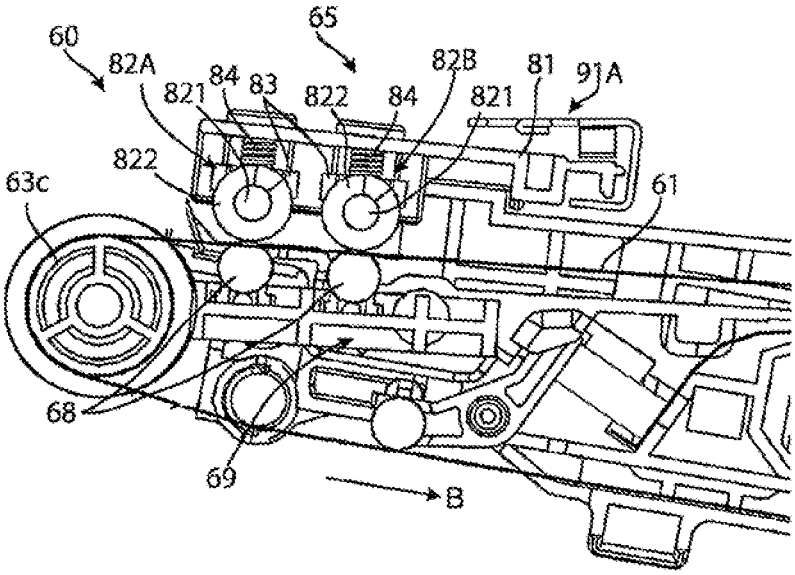
FIG. 6 is a sectional view in a state where the intermediate transfer unit is inserted into the apparatus housing.

Furthermore, FIG. 6 is a sectional view in a state where the intermediate transfer unit is inserted into the apparatus housing.

As illustrated in FIG. 6, the frame guides 91A and 91B on the apparatus housing side have a shape close to a U-shaped cross section. The frame of the intermediate transfer unit 60 is inserted into the two frame guides 91A and 91B, and further, positioning bosses (not illustrated) protruding from a front wall 66 of the intermediate transfer unit 60 in an insertion direction are inserted into positioning holes 92 of the frame guides 91A and 91B.

Here, a frame 81 of the second cleaner 65 is inserted into one frame guide 91A of the two frame guides 91A and 91B. As described above, the intermediate transfer unit 60 has a backlash between the members that configure the intermediate transfer unit 60.

Here, two cleaning rolls 82A and 82B are provided in the second cleaner 65. The cleaning rolls 82A and 82B need to be in contact with the intermediate transfer belt 61 with a predetermined strength in order to exhibit a predetermined cleaning performance. When realizing this, the frame 81 of the second cleaner 65 is firmly fixed to a main body frame 69 inside the intermediate transfer belt 61, and in the own structure of the immediate transfer unit 60, it is considered that the two cleaning rolls 82A and 82B are pressed against the intermediate transfer belt 61. However, in this case, there is a concern that the frame structure becomes more complicated than that of the exemplary embodiment and weight and size increase. Therefore, in the exemplary embodiment, in order to realize this, the frame guide 91A into which the frame 81 of the second cleaner 65 is inserted is used. In other words, in the exemplary embodiment, the intermediate transfer unit 60 is inserted into the apparatus housing 90 and fixed in the apparatus housing 90, and accordingly, the frame 81 of the second cleaner 65 is fixed to the main body frame 69 via the frame guide 91A. In other words, the frame guide 91A presses the cleaning rolls 82A and 82B against the intermediate transfer belt 61 through the frame 81 of the second cleaner 65. In the exemplary embodiment, by using the frame guide 91A in this manner, the cleaning rolls 82A and 82B are pressed against the intermediate transfer belt 61 with a predetermined strength, and a predetermined cleaning performance is exhibited. With this configuration, the strength of the frame 81 of the second cleaner 65 is reduced compared to a case where the frame guide 91A is not used, and the light intermediate transfer unit 60 is obtained.

Here, the frame guide 91A in the exemplary embodiment corresponds to an example of a guide part referred to in the present disclosure, and the frame 81 of the second cleaner 65 corresponds to an example of a support guide receiving part referred to in the present disclosure. In addition, the cleaning rolls 82A and 82B correspond to an example of a contact cleaning part according to the present disclosure.

The two cleaning rolls 82A and 82B of the second cleaner 65 have a structure in which a foamed material 822 surrounds a shaft 821. The shafts 821 of the two cleaning rolls 82A and 82B are supported by bearings 83 disposed at both end portions on the near side and the far side in a direction of the shaft 821. Here, the bearing 83 is a bearing opened on the intermediate transfer belt 61 side, and the cleaning rolls 82A and 82B are pressed against the intermediate transfer belt 61 via the bearing 83 by a spring 84. In addition, backing rolls 68 that prevent deformation of the intermediate transfer belt 61 due to the pressing of the cleaning rolls 82A and 82B is disposed at a position facing the cleaning rolls 82A and 82B with the intermediate transfer belt 61 interposed therebetween. Here, the shaft 821 can be brought close to the intermediate transfer belt 61 by adopting the bearing 83 opened on the intermediate transfer belt 61 side, and by adopting the cleaning roll having a smaller diameter than that in a case where the bearing that surrounds the shaft 821 along the whole circumference, it is possible to reduce the overall size. In the exemplary embodiment, since the two cleaning rolls 82A and 82B are provided, the residues are removed more efficiently than when only one cleaning roll is provided. In addition, the cleaning rolls 82A and 82B in the exemplary embodiment each include a foamed material, so that the irregularities formed by the foaming can be used to efficiently remove residues, as compared to a case where no foamed material is employed. Furthermore, in the exemplary embodiment, by adopting the roll-shaped contact cleaning part, the intermediate transfer belt 61 can circulate smoothly compared to a case where a contact cleaning part that does not have a roll shape is employed. Furthermore, in the exemplary embodiment, the second cleaner 65 is disposed on the upper portion of the intermediate transfer belt 61. Accordingly, the cleaning rolls 82A and 82B are more stably pressed against the intermediate transfer belt 61 than when the second cleaner 65 is disposed below the intermediate transfer belt 61, and the residues can be stably removed from the intermediate transfer belt 61.

In this case, the two cleaning rolls 82A and 82B may include one type of foamed members, specifically, foamed members having the same fineness of surface irregularities. Alternatively, the two cleaning rolls 82A and 82B may be two types of foam members with different levels of fineness of surface irregularities. In this case, the cleaning roll 82A downstream of the cleaning roll 82B upstream in the circulation direction of the intermediate transfer belt 61 includes a foamed member with fine surface irregularities. By doing so, relatively large residues are removed by the upstream cleaning roll 82B, and further small residues are removed by the downstream cleaning roll 82A. Accordingly, the residues are divided into two types depending on the size of the grains, and the residues are more efficiently removed.

In the second cleaner 65 of the exemplary embodiment illustrated here, the cleaning rolls 82A and 82B are provided as contact cleaning parts, but the contact cleaning part referred to in the present disclosure is not necessarily in a roll shape, and a blade-shaped contact cleaning part may be included. In this case, compared to a case where the blade-shaped member is not included, the type of residue that is efficiently removed by the blade-shaped member is efficiently removed. Moreover, both the blade-shaped contact cleaning part and the roll-shaped contact cleaning part may be provided. In this case, the residues are more efficiently removed by the blade-shaped contact cleaning part and the roll-shaped contact cleaning part.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An intermediate transfer device comprising:

an endless belt configured to circulate, to receive transfer of a toner image at a first transfer position, and to hold the toner image until the toner image reaches a second transfer position at which the toner image is transferred to a transfer receiver;

a first cleaning unit that is disposed downstream of the second transfer position and upstream of the first transfer position in a circulation direction of the belt, wherein the first cleaning unit is configured to remove residual toner from the belt after transfer; and a second cleaning unit that is disposed downstream of the first cleaning unit and upstream of the first transfer position in the circulation direction, wherein the second cleaning unit is configured to remove residues from the belt after removal by the first cleaning unit, wherein second cleaning unit comprises:

a contact cleaning part that extends in a width direction intersecting the circulation direction and is in contact with the belt; and a support guide receiving part that supports the contact cleaning part, wherein the support guide receiving part is configured to receiver a guide for attachment to and detachment from an image forming apparatus main body by sliding in the width direction.

2. The intermediate transfer device according to claim 1, wherein the second cleaning unit is disposed above the belt.

3. The intermediate transfer device according to claim 2, wherein the contact cleaning part includes a roll-shaped member, and wherein the support guide receiving part supports the contact cleaning part via bearings disposed at both ends in the width direction.

4. The intermediate transfer device according to claim 3, wherein each bearing is open on the belt side, and wherein the contact cleaning part is pressed against the belt such that the part is supported by the bearings.

5. The intermediate transfer device according to claim 1, wherein the contact cleaning part has a surface in contact with the belt, and wherein the surface is made of a foamed material.

6. The intermediate transfer device according to claim 1, wherein the contact cleaning part includes a plurality of roll-shaped members arranged in the circulation direction.

7. The intermediate transfer device according to claim 6, wherein each of the plurality of roll-shaped members has a surface in contact with the belt, and wherein the surface is made of a foamed material.

8. The intermediate transfer device according to claim 7, wherein the plurality of roll-shaped members include a first member that is disposed on a most upstream side in the circulation direction and has a surface being in contact with the belt and made of a first foamed material, and wherein the plurality of roll-shaped members also include at least one second member that is disposed downstream of the first member in the circulation direction and has a surface being in contact with the belt and made of a second foamed material having surface irregularities finer than those of the first foamed material.

9. The intermediate transfer device according to claim 1, wherein the contact cleaning part includes a blade-shaped member.

10. The intermediate transfer device according to claim 9, wherein the contact cleaning part further includes a roll-shaped member in addition to the blade-shaped member.

11. An image forming apparatus comprising:

an image forming apparatus main body including a guide part configured to guide attachment and detachment of the intermediate transfer device according to claim 1 by guiding the sliding of the support guide receiving part in the width direction, wherein the image forming apparatus is configured to form an image on a paper sheet by using the intermediate transfer device mounted on the image forming apparatus main body.

12. The image forming apparatus according to claim 11, wherein the guide part is configured to press the contact cleaning part toward the belt via the support guide receiving part.

* * * * *